United States Patent [19]

Althen

[11] 4,253,279

[45] Mar. 3, 1981

[54] PRECISION HONING DEVICE

[75] Inventor: Wayne W. Althen, Ladue, Mo.

[73] Assignee: Sunnen Products Company, St. Louis, Mo.

[21] Appl. No.: 61,599

[22] Filed: Jul. 30, 1979

[51] Int. Cl.[3] ..... B24B 5/00; B24B 33/02

[52] U.S. Cl. ..... 51/1; 51/346; 51/355; 51/380; 51/241 VS; 51/DIG. 6

[58] Field of Search ..... 51/1, 206 R, 206 P, 51/338, 340–344, 346, 363, 372, 375, 380, 382, 241 VS, DIG. 6, 355

[56] References Cited

U.S. PATENT DOCUMENTS

| | | | |
|---|---|---|---|
| 141,712 | 8/1873 | Hawkins | 51/206 R |
| 1,865,229 | 6/1932 | Birgbauer | 51/DIG. 6 |
| 2,178,491 | 10/1939 | Palotce | 51/206 P |
| 2,892,292 | 6/1959 | Whitney | 51/375 |
| 3,526,057 | 9/1970 | Hackman | 51/1 |
| 3,717,956 | 2/1973 | Keatts | 51/1 |
| 4,173,852 | 11/1979 | Fitzpatrick | 51/380 |
| 4,197,680 | 4/1980 | Althen et al. | 51/343 |

FOREIGN PATENT DOCUMENTS

| | | | |
|---|---|---|---|
| 224033 | 7/1910 | Fed. Rep. of Germany | 51/372 |
| 237973 | 9/1911 | Fed. Rep. of Germany | 51/206 R |
| 2460997 | 7/1976 | Fed. Rep. of Germany | 51/338 |

*Primary Examiner*—Harold D. Whitehead
*Assistant Examiner*—K. Bradford Adolphson
*Attorney, Agent, or Firm*—Charles B. Haverstock

[57] ABSTRACT

A precision honing device including a substantially tubular honing member having an outer work engaging surface, an axially tapered inner surface, a full length slit through the device along one side thereof, and a layer of a relatively hard wear resistance abrasive substance applied to the outer work engaging surface, the work engaging outer surface of the device having an axial taper formed by a first portion extending to adjacent one end that has a first rate of taper, a second portion extending to adjacent the first portion having a rate of taper that is less than the rate of taper of the first portion, and a third tapered portion extending from the second portion on the opposite side thereof from the first portion, the third portion being axially tapered at a reverse taper relative to the tapers of the first and second portions, the taper of the first portion causing a greater rate of stock removal during honing than the taper of the second portion.

16 Claims, 8 Drawing Figures

PRECISION HONING DEVICE

BACKGROUND OF THE INVENTION

Many honing mandrels and other honing devices have been constructed and used in the past. For the most part, the known constructions have used honing stones and other abrasive members which are adjustable radially during a honing operation in order to maintain them engaged with a work surface as the work surface is enlarged and as the stones wear. Typical of such honing mandrels are the mandrels disclosed in Sunnen U.S. Pat. Nos. 2,532,682, dated Dec. 5, 1950; 2,580,327, dated Dec. 25, 1951; 2,580,328; dated Dec. 25, 1951; 2,799,127; dated July 16, 1957; 2,815,615, dated Dec. 10, 1957; and 3,800,482, dated Apr. 2, 1974. Honing devices of the types disclosed in these patents are well known and widely used and the present construction is not designed or constructed to replace them. Another type of work engaging honing device is disclosed in Althen et al U.S. Pat. No. 4,197,680. The honing device disclosed in this copending application is pertinent to the present construction but does not disclose the use of more than one differently axially tapered portion to produce very accurate honing, and this feature of the present construction in addition to producing accurate honed surfaces also provides important advantages over the known prior art as will be explained.

SUMMARY OF THE INVENTION

The present honing device is designed to be moved only once through a work surface such as a cylindrical or knurled bore to remove material and to accurately size the surface and improve the characteristics thereof. It is not the intention of the present mandrel device, however, to be adjustable during a honing operation, and it is contemplated that the present construction will use as its work engaging surface particles of a relatively hard wear resistance abrasive substance such as diamond particles, particles of cubic boron nitride or particles of some other relatively hard wear resistant substance in a binder. Such substances are known to be relatively expensive but also undergo relatively little wear even after repeated use. The subject construction is designed to be adjustable within limits to compensate for wear, and to a limited degree is also adjustable as to size but not during operation. Some of the advantages by being able to finish and accurately size a work surface during a single pass of the device through the work include more rapid honing to size, more uniform distribution of the cutting load, mimimizing the possibility of producing areas of high load concentration and wear, reduced power requirement, and better honing accuracy. A properly constructed device can significantly improve the life of the tool and increase stock removal capability. The present honing devices are especially adaptable for resizing bores, such as valve stem bores, including bores that have been knurled by means such as the knurling devices disclosed in copending Estes et al U.S. patent application Ser. No. 15,706, although they can also be used for many other honing applications.

It is therefore a principal object of the present invention to teach the construction and operation of a honing device for very accurately finishing and sizing work surfaces.

Another object is to provide a honing device which better distributes and takes on load during operation.

Another object is to provide a honing device that has a relatively long life expectancy.

Another object is to teach the construction and operation of a relatively simple honing mandrel construction which does not require adjustment during operation but which can be adjusted within limits to compensate for wear and to provide size adjustment within a limited range.

Another object is to teach the construction of a honing device that can be constructed in sizes for honing very small diameter bores.

Another object is to provide a honing device having means associated therewith for the circulation of honing oil and other lubricants and coolants.

Another object is to teach the construction and operation of a honing mandrel which is relatively easy to assemble and to adjust.

Another object is to provide a honing device which is relatively safe to use and is constructed so as to minimize the possibility for binding or jamming.

Another object is to enable the production of more accurately sized surfaces produced during honing.

Another object is to minimize the possibility of slippage between the parts of a honing mandrel.

Another object is to provide a mandrel construction that removes material at a faster rate during the initial portion of a honing operation than during later portions thereof.

Another object is to provide a honing device wherein the work load is distributed over a relatively large work engaging surface.

A further object is to provide a substantially cylindrical honing device having a work engaging surface that has at least two adjacent but differently tapered portions.

Another object is to teach the construction of a honing device that provides more even chip distribution as the honing mandrel passes through the work.

Another object is to provide a honing mandrel that has little or no tendency to bind as it passes through the work.

Another object is to enable more accurate honing of cylindrical surfaces even by persons having relatively little skill and training.

Another object is to provide means to accurately resize knurled surfaces.

BRIEF DESCRIPTION OF DRAWINGS

These and other objects and advantages of the present invention will become apparent after considering the following detailed specification in association with the accompanying drawings wherein.

DETAILED DESCRIPTION

Figure 1:
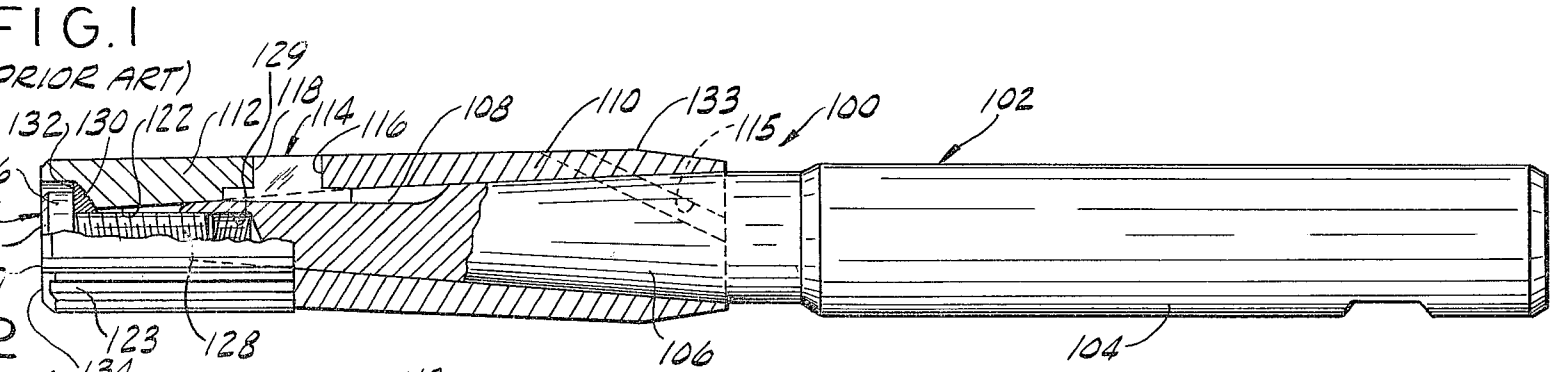
FIG. 1 (PRIOR ART)
FIG. 1 is a cross-sectional view through the honing mandrel shown in copending U.S. patent application Ser. No. 916,518.
Figure 2:
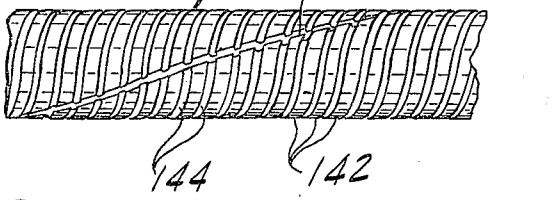
FIG. 2 (PRIOR ART)
FIG. 2 is a fragmentary side elevational view of the abrasive honing member employed on the mandrel of FIG. 1.
Figure 4:
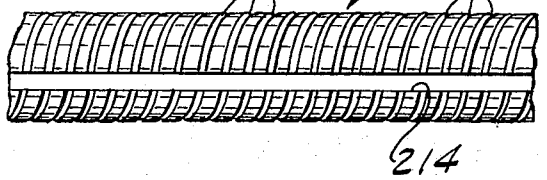
FIG. 4 is a side elevational view of a tubular honing member per se constructed according to the present invention.

Referring to the drawings more particularly by reference numbers, FIGS. 1 and 2 are views taken from U.S. Pat. No. 4,197,680 by Wayne W. Althen and Harold T. Rutter. FIGS. 1 and 2 correspond to FIGS. 3 and 4 of the said patent, and the numbering of the parts in FIGS. 1 and 2 are the same as in the patent. The description of the copending application is incorporated herein by reference.

FIG. 1 shows a honing mandrel embodiment 100 which includes an arbor 102 with a cylindrical portion 104 for mounting it on a honing machine. The arbor 102 also has a tapered portion 106 with elongated keyway 108 formed therein. The construction 100 also has a tubular honing member 110 and a pilot member 112 both mounted on the tapered portion 106. The honing member 110 and the pilot member 112 are held against relative rotation on the portion 106 by means of T-shaped key 114 which cooperates with end slots 116 and 118 in the members 110 and 112 respectively and with the keyway 108 in the tapered arbor portion 106. The honing member 110 is constructed of a relatively strong tough metal that is somewhat resilient and has a full length helical slot or groove 115 therethrough which enables the member to expand and contract to some extent.

In the construction shown in FIG. 1 the pilot member 112 has an axial slot 120 therethrough which extends the length thereof, and a plurality of other full length grooves 123 (only one being shown) formed therein. The pilot member 112 also has a tapered inner surface 122 which cooperates with the tapered arbor portion 106. Because of the need for some adjustment, portions of the construction shown in FIG. 1 can be made to be relatively short and therefore also relatively strong while at th same time providing means for making axial and radial adjustments of the honing member 110 as required. Also the construction shown in FIG. 1 has a threaded adjustment member 124 which includes a head portion 126 and a threaded portion 128 which cooperates with an axially threaded bore 129 formed in the end of the tapered arbor portion 106. The construction 100 has an annular washer 130 which is positioned in a socket 132 formed in the pilot member 112. The washer 130 cooperates with the head portion 126 of the adjustment member 124 and with the pilot member 112 to minimize binding of the adjustment member 124 thereon during adjustment, and to accommodate expansion of the pilot member 112. With the construction as shown in FIG. 1, the pilot member 112, like the honing member 110, is able to increase somewhat in diameter during adjustment, and the slot 120 and the grooves 123 are provided to facilitate this. The grooves 123 are at spaced locations around the pilot member 112 to facilitate the necessary expansion (or contraction) thereof during adjustment.

When adjustments are made by rotating the member 124, the total length of the member 110 expands by the same amount so that the difference between the diameter of the device at the high spot or crown 133 and at the pilot member 112 remains constant. This has been found to be an important factor to maintaining the honing accuracy of the device.

The end surface 134 of the pilot member 112 and the end surface 136 of the adjustment member 124 may have suitable indicator lines or scales to show the relative positions of the members and provide means to determine or keep track of how much adjustment has been made. In an actual device it has been found that some limited adjustment of the honing diameter can be made in the manner indicated. This usually ranges upwardly from a few thousandths of an inch or more and is highly desirable. However, if too much expansion of the tubular honing member occurs the honing member may not be able to return to its initial unstressed condition and this can destroy part of the usefulness of the device. Therefore, if different dimensions are required to be honed it may be necessary to provide similar separate mandrels and tubular honing sleeves for each.

FIG. 2 is a side view of the honing member 110 shown having a helical groove 115 therethrough extending from end to end. The outer surface 140 of the member is coated or plated with an abrasive layer 142 such as a layer which includes diamond particles or particles of cubic boron nitride in a suitable binder. The outer surface has a helical groove 144 which usually is relatively shallow and is included for lubricating purposes, and in some cases also to reduce the surface area that needs to be plated with abrasive material.

Figure 3:
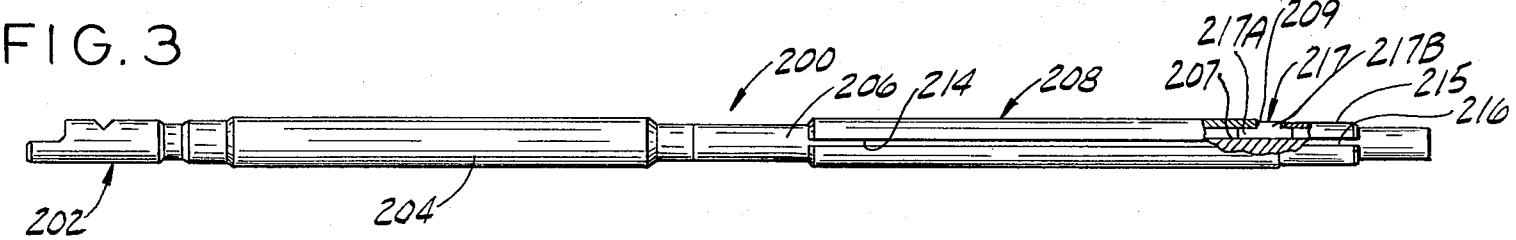
FIG. 3 is a side elevational view of a honing mandrel having a substantially tubular honing member constructed according to the present invention.

FIG. 3 shows a mandrel 200 having means 202 at one end for mounting it in a honing machine, a cylindrical arbor portion 204, and a tapered arbor portion 206 on which a substantially tubular abrasive honing sleeve 208 is mounted. The sleeve 208 is the most important part of the construction and is shown more in detail in FIG. 4 wherein small helical grooves 210 for lubricating purposes extend the length thereof. The sleeve 208 also has a full length axial or helical slit 214 through one side which enables the member to expand (or contract) when positioned on the tapered portion 206 of the mandrel 200 and adjusted. The construction of the sleeve 208 including especially the contour of the abrasive outer work engaging surface is important to the present invention. The construction is shown in greatly exaggerated form in FIGS. 5 and 7 which show the device being used to size bores having burrs on them and knurled bores. The device also includes a tubular pilot member 215 which has a slit 216 along one side to permit expansion and contraction thereof. A T-shaped key member 217 has a first elongated portion 217A which cooperates with a uniform depth groove 207 in the tapered arbor portion 206 and an outwardly extending key portion 217B which cooperates with an axially extending notch 209 formed in the end of the sleeve 208. The key 217 is included to prevent relative rotational movement between the sleeve 208 and the arbor portion 206. A notch for the key portion 217B can also be formed in the end of the pilot member 215 but this is usually not necessary in the present construction wherein the pilot member 215 is not threadedly attached to the arbor as was done in prior constructions.

Figure 5:
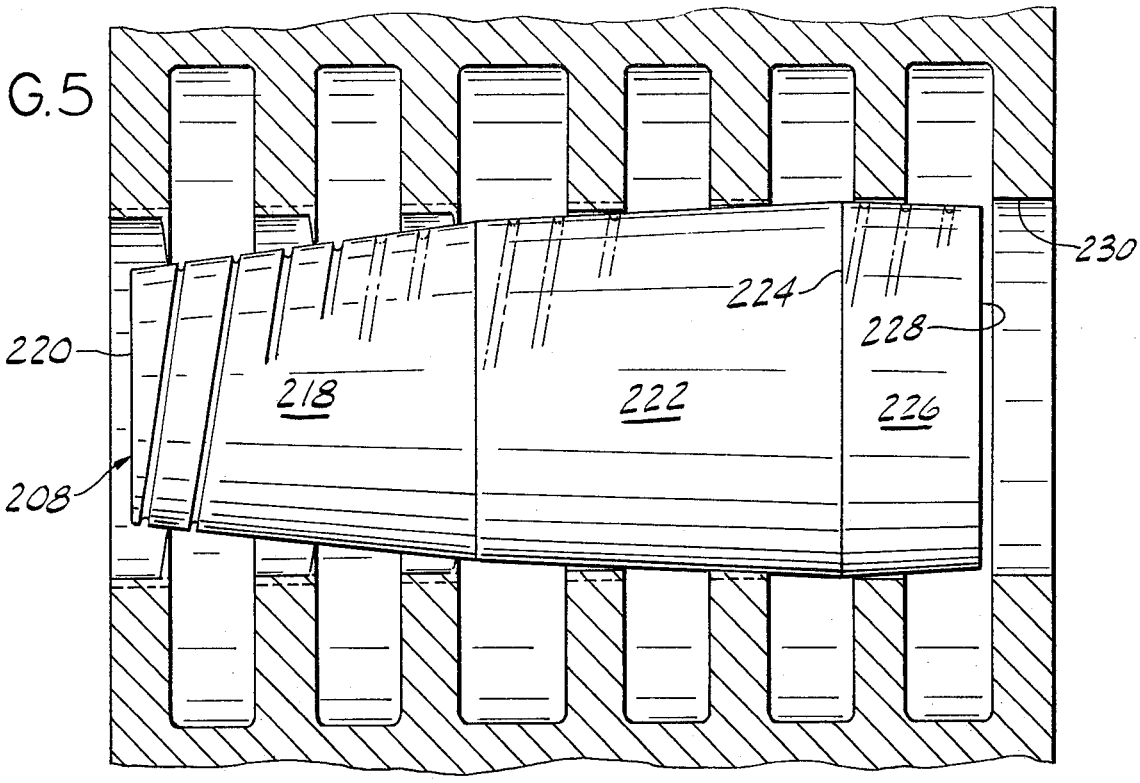
FIG. 5 is a enlarged and greatly exaggerated fragmentary cross-sectional view of a tubular honing member constructed according to the present invention and shown in operational engagement with a workpiece surface, the workpiece being typical of a hydraulic control valve body.

In FIG. 5 the sleeve 208 is shown having a first axially tapered portion 218 which extends from adjacent to the smaller diameter end 220 of the sleeve, and a second axially tapered portion 222 which extends from the tapered portion 218 reaching a high point or crown at 224. The diameter of of the crown is the desired final diameter of a bore to be honed by the subject device. Thereafter the sleeve has a reverse taper at 226 extending from the crown 224 to adjacent the opposite sleeve end 228. The surfaces 218 and 222 as well as the surface 226 are frusto-conical surfaces. It is significant to the present construction that the taper of the portion 218 be steeper than the taper of the sleeve portion 222 because this means that during honing when the sleeve is rotating and moving axially into a bore, the smaller diameter sleeve end 220 first enters the bore, such as workpiece bore 230, and most of the stock removal occurs during the time while the bore surface is enaged with the more steeply tapered sleeve portion 218. Thereafter the bore surface will come in contact with the more gradually tapered sleeve portion 222 which removes stock at a lesser rate thereby gradually accurately sizing the bore surface until the bore surface moves past the crown 224 which establishes the final accurate diameter of the bore or workpiece surface. Thereafter as the sleeve 208 moves the remaining distance through the workpiece bore little or no further honing or stock removal will occur due to the reverse taper of the surface portion 226 of the sleeve. What this means is that most of the load, most of the stock removal, and most of the wear that occurs is borne by and is due to the more steeply tapered sleeve portion 218, and relatively less stock removal, less load and less wear is due to the less steeply tapered portion 222. Yet the more gradually tapered portion 222, including the crown 224, are the portions that determine and control the final size or diameter of the honed surface. These are highly desirable operating conditions especially insofar as the honing accuracy that can be achieved is concerned, and these desirable conditions also substantially prolong the useful life of the sleeve 208. Furthermore, any adjustment in the honing diameter including the diameter of the crown portion 224, to compensate for sleeve wear or to correct the honing diameter, can be made by relocating the sleeve 208 on the tapered mandrel portion 206. These features are highly desirable and enable the present device to be used to hone bore surfaces to precise sizes.

Figure 8:
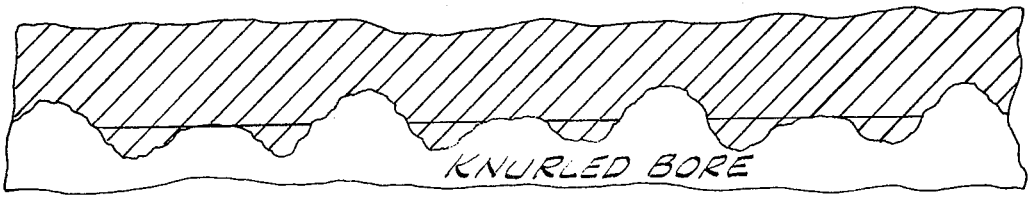
FIG. 8 is an enlarged fragmentary cross-sectional view showing a segment of an actual knurled bore surface prior to being honed, said view including a line depicting the depth of the material to be removed during honing.

The subject mandrels, including the sleeves 208, are particularly useful in accurately honing bore surfaces, including especially relatively small bore surfaces, and bore surfaces that have been knurled. This is true of those bores in engine heads which movably accommodate the valve stems associated with the intake and exhaust ports. Such bores can be reduced in diameter by first being knurled using a knurling tool such as disclosed in copending U.S. patent application Ser. No. 15,706. A greatly enlarged fragmentary cross-section of a bore that has been knurled in this manner is shown in FIG. 8. After such a bore has been knurled, the subject mandrel, with a sleeve properly sized and positioned thereon, can be used to hone the ridges or high spots of the knurled surface to enlarge the knurled surface to some desired size of diameter such as to the bores original diameter when the engine block was new so that it is not necessary to install oversized valve stems. The subject tool can accomplish this with extremely precise accuracy and during a single pass of the tool through the bore. It is to be recognized, however, that for a typical application such as for honing knurled valve stem bores, the degree or rate of taper of the portions 218 and 222, while very important, is usually also very small.

In actual practice, it has been found that the selection of a single suitable taper for a mandrel chosen to optimize all operating conditions including stock removal, load on the mandrel, prevent concentrating the load and wear on certain parts of the mandrel more than on others, and to enable the mandrel to operate with minimum power may not be possible when honing an actual bore to some predetermined size. The selection of a single suitable taper will be further aggravated when one or more burrs exist in a bore or when a bore has been knurled prior to honing to reduce its effective diameter. In such cases, if a relatively shallow single tapered member is used, unless the member is unreasonably long, the amorphous metal from the burr or knurl will tend to pile up and deposit metal on the leading edge portion of the tool. Such metal deposits can score and even friction weld metal to the workpiece, and this can destroy the tool as well as the workpiece. On the other hand, if the tool is constructed to have a steeper, shorter taper to accommodate such burrs or knurling, the chips from the amorphous metal will be distributed over a wider band of the tool, and the effect of this is to cause the chips from the base metal to load and clog up the abrasive clearance spaces in a relatively narrow band of the tool, usually a band located relatively near the crown. Such loading produces excessive wear, shortens the tool life, and substantially increases the power required to drive the mandrel.

To accommodate and overcome these and other various conditions most effectively a sleeve having portions of different taper is desirable including a sleeve having a first portion with a relatively steep taper and a second portion with a somewhat shallower taper. In the present construction both such tapers are combined in the same sleeve. The first taper portion to encounter the work, as indicated, is the steeper taper portion which operates to distribute the amorphous chips encountered over a relatively broad band of the tool, while the second, shallower tapered portion, will prevent high chip volume from occurring near the crown by distributing the base metal chips over a broad band of the shallow taper. Data on tests of several different sleeve constructions having single or multiple tapered portions are set forth below. In one case a relatively shallow uniformly tapered member was used to hone bores in hydraulic control valve bodies that may have some burring, in another case a single but steeper tapered honing member was used, and in a third case a double tapered construction was used. In a still further example a sleeve construction for honing reconditioned valve guide bores that had previously been knurled before being honed is described.

EXAMPLE 1: HYDRAULIC CONTROL VALVE BODY WITH BURR (See FIG. 5)

| | |
|---|---|
| Desired finished diameter: | .6250 inch |
| Starting diameter of base metal | .6230 inch |
| Effective diameter of burrs: | .6170 inch |
| (a) Shallow Single Taper Design | |
| Length of abrasive member: | 3¾ inches |
| Rate of taper: | .001 inch per |

-continued

| | |
|---|---|
| | inch for 3½ inches of tool length. |
| Rate of reverse taper at trailing end: | .002 inch per inch for ¼ inch of tool length. |

This tool was designed and used to try to achieve the best possible chip distribution, the longest possible tool life, and the lowest possible power consumption when removing from between about 0.002 inch to about 0.003 inch of base metal stock. With only about 0.0035 inch total taper, the forward end of the sleeve had a diameter of 0.6215 inch which was 0.0045 inch larger than the effective burr diameter. The volume of chips in this 0.0045 inch burr was concentrated at or near the leading edge of the tool and caused a loading condition which resulted in scoring and eventual destruction of the tool.

| | |
|---|---|
| (b) Steeper Single Taper Design | |
| Length of abrasive member: | 3¾ inches |
| Rate of taper: | .0023 inch per inch for 3½ inches |
| Rate of reverse taper at trailing end: | .002 inch per inch for ¼ inch |

This design provided for distribution of the amorphous chips over the length of the tool. By having approximately 0.008 inch total taper, the forward end of the tool entered the burr diameter and spread the chips for approximately the first 2⅝ inch of the tool before reaching the base metal. However, the base metal chips were spread over a relatively narrow portion of the tool that was approximately ⅞ inch wide near the crown of the tool. This caused tool loading, shortened the tool life, and substantially increased the power required to drive the tool as compared to the shallower single taper tool described above.

| | |
|---|---|
| (c) Double Taper Design | |
| Length of abrasive member: | 3¾ inches |
| Rate of taper for steeper taper portion: | .004 inch per inch for 1½ inches |
| Rate of taper for shallower taper portion: | .001 inch per inch for 2 inches |
| Rate of reverse taper at trailing end: | .002 inch per inch for ¼ inch |

The double taper design provided a total taper of approximately 0.008 inch which allowed the tool to enter the burr diameter and spread the amorphous chips relatively uniformly over the first 1½ inch of the tool. The base metal chips were then spread relatively uniformly over the next 2 inches of the tool, thus combining the best features of both tapers.

EXAMPLE 2: AUTOMOTIVE VALVE GUIDE BORES RECONDITONED BY KNURLING

| | |
|---|---|
| Desired finished diameter: | .3438 inch |
| Starting diameter: | .3445 inch |
| Knurl diameter: | .335 inch |

Figure 7:
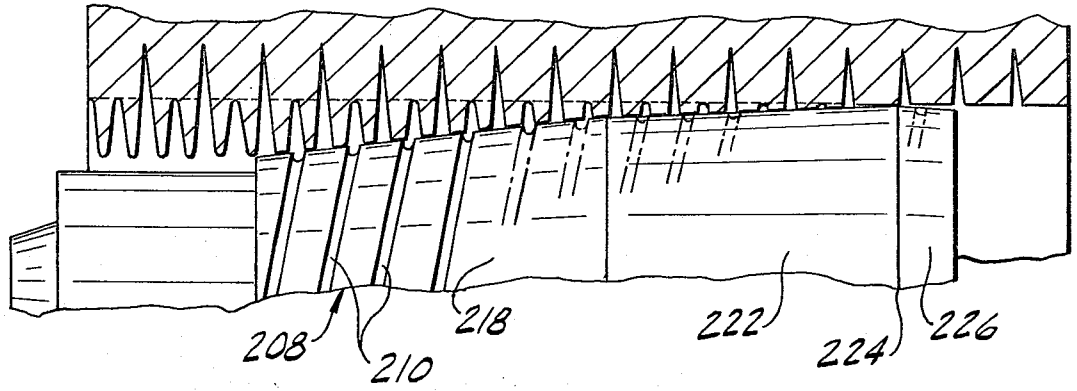
FIG. 7 is another exaggerated fragmentary cross-sectional view showing the subject honing device in operative engagement with a knurled bore during honing thereof.

Because the starting diameter is 0.0007 inch larger than the finished diameter, no base metal is encountered when honing a knurled valve guide, see FIGS. 7 and 8. However, the tool does encounter an increasing volume of chips as the knurled bore gets closer to the desired finished size, see FIG. 6. This increasing volume of chips calls for a decreased rate of taper, and a practical design to accomplish this operation has been shown to be:

| | |
|---|---|
| Length of abrasive member: | 3 inches |
| Rate of taper for steeper portion: | .0048 inch per inch for 1½ inches |
| Rate of taper for shallower portion: | .0016 inch per inch for 1¼ inches |
| Rate of reverse taper for trailing end: | .002 inch per inch for ¼ inch. |

In addition to the double tapered tool being useful for honing knurled valve guides, the same tool can be used for honing bores for replacement guides that are as much as 0.0015 inch smaller than the desired finished diameter. While the double taper design is described above for use in honing knurled bores and bores with burrs, the design also has the advantage of increasing the stock removal capability of the tool when the tool is used to hone a bore that has any amorphous metal in it such as bores that are rough reamed or bored.

It is to be understood, however, that the rate of taper of the different tapered portions of the subject tool, the relative length of each of the differently tapered portions, the honing diameter to be achieved, the nature of the surface to be honed or sized, the kind of metal to be honed, as well as the type and size of the particles that form the abrasive surface, can all be varied and to some extent will affect the results that are achieved. The important thing is that with the subject improved construction the use of a double tapered work engaging surface, preferably with a shortened reverse taper at the trailing end, achieves the beneficial results described above.

Figure 6:
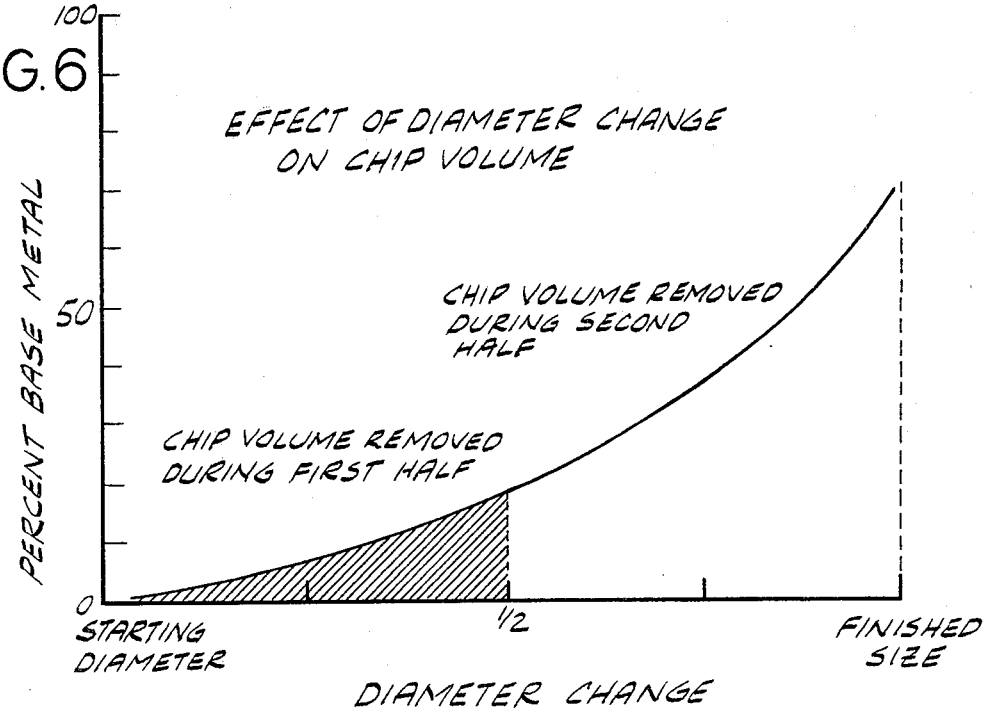
FIG. 6 is a graph of bore size plotted against percent of base metal removed during honing of a typical knurled bore.

FIG. 6 is a graph of diameter change during a honing operation wherein it can be seen that when the diameter has been increased by 50% of the total increase during a honing operation only a relatively small portion of the total volume of material to be removed will have been removed. This is indicated by the shaded area in FIG. 6. Thereafter during honing the diameter will be enlarged to the final finished diameter, and during the second half of the honing operation a much greater volume of material will be removed even though the diameter change is the same as before (see unshaded area). In this graph the left hand vertical line at zero represents the starting size or diameter of a knurled bore, and the right hand side of the graph represents the desired finished bore size or diameter achieved after honing. It can be seen from the graph that most of the stock removal takes place during the second half of the honing operation. The graph of FIG. 6 is a plot that relates specifically to a knurled surface such as the knurled surface shown in FIG. 8. The shape of the graph will vary, however, for other types of surfaces such as for the burred surface shown in FIG. 5. In all cases the volume of the chips removed will increase as the honing process proceeds and as the diameter increases. These are highly desirable conditions to prevent excessive loading and corresponding high torque and power consumption.

FIG. 7 is another substantially enlarged and exaggerated fragmentary cross-sectional view showing in greatly magnified form some of the same things that are shown in FIG. 5. In FIG. 7 the relationship is between the honing sleeve 208 and a knurled bore surface. In FIG. 7 the horizontal dimension of an actual sleeve is shown magnified two times, while the vertical dimension of the sleeve and of the workpiece are magnified a hundred times. The bore shown in FIG. 7 is a knurled valve guide bore such as described above, and FIG. 7 even better illustrates the relative amount of stock removal that occur due to engagement by the knurled bore surface and the differently tapered sleeve portions. It is to be recognized, however, that the subject abrasive sleeves can be used to accurately hone many different types and sizes of bores including bores having knurled as well as cylindrical surfaces.

For most applications where the subject double tapered honing members have been used, the rate of taper of the differently tapered portions fall within certain ranges. For the more steeply tapered portions of the abrasive members, which are the portions that do most of the diameter enlargement, a rate of taper between about 0.001 inch per inch of tool and 0.010 inch per inch of tool has been found to produce very satisfactory results. For the less steeply tapered portion the rate of taper should be between about 0.0001 inch per inch of tool and 0.004 inch per inch of tool. As indicated above, the selection of particular rates of taper for particular jobs will depend on tool length, lengths of the different tapered portions, hole size, burrs, amorphous metals involved and characteristics, abrasive used, metal to be honed and other factors.

Thus there has been shown and described a novel honing device which fulfills all of the objects and advantages sought therefor. It will be apparent to those skilled in the art, however, that many changes, modifications, variations, and other uses and applications for the subject devices are possible. All such changes, modifications, variations, and other uses and applications which do not depart from the spirit and scope of the invention are deemed to be covered by the invention which is limited only by the claims which follow.

What is claimed is:

1. A honing device for honing bore surfaces comprising a tubular sleeve having a smaller diameter first end and outer work engaging surface formed by a surface layer including particles of a relatively hard wear resistant abrasive material, and inner surface tapered from end-to-end of the sleeve, a slot through said sleeve from end-to-end to facilitate expansion and contraction thereof, said outer abrasive surface having a first constant frusto-conical shaped portion extending from adjacent to the smaller diameter first end of the sleeve to a larger diameter opposite end intermediate the length of the sleeve, a second frusto-conical shaped portion extending from and contiguous with the larger diameter end of the first portion to a still larger diameter opposite end, the rate of axial taper of the first frusto-conical shaped portion being greater than the rate of the axial taper of the second frusto-conical shaped portion whereby the first portion will remove material from a bore surface being honed thereby at a faster rate than the second portion, the larger diameter end of the second frusto-conical shaped portion determining the final diameter to which the bore surface is honed.

2. The honing device defined in claim 1 wherein the outer work engaging surface includes a third frusto-conical shaped portion extending from and contiguous with the larger diameter end of the second portion to adjacent the opposite end of the tubular sleeve, the taper of said third frusto-conical shaped portion being such that the minimum diameter of said third frusto-conical shaped portion is adjacent to said opposite sleeve end.

3. The honing device defined in claim 1 wherein a helical groove is formed in the outer work engaging surface and extends substantially from end-to-end of the sleeve.

4. The honing device defined in claim 2 wherein the outer work engaging surface has its maximum diameter at the juncture between the second and third frusto-conical shaped portions thereof.

5. The honing device defined in claim 1 wherein the axial taper of the first frusto-conical shaped portion along the sleeve is at a rate between approximately 0.001 inch per inch and 0.010 inch per inch, and the rate of axial taper of the second frusto-conical shaped portion is at a rate between approximately 0.0001 inch per inch and 0.004 inch per inch.

6. The honing device defined in claim 1 wherein the outer work engaging surface includes diamond particles in a binder.

7. The honing device defined in claim 1 wherein the outer work engaging surface includes particles of cubic boron nitride in a binder.

8. The honing device defined in claim 1 wherein said tubular sleeve is formed of a relatively hard somewhat resilient metal.

9. A honing mandrel for honing bore surfaces comprising a tubular sleeve having an outer abrasive work engaging surface including particles of an abrasive substance in a binder, said sleeve having spaced first and second opposite ends and a tapered inner surface extending therebetween, a slot through the sleeve extending the length thereof to enable expansion and contraction thereof, said outer abrasive surface having first, second and third frusto-conical shaped surface portions which together extend most of the distance between the spaced opposite sleeve ends, the first frusto-conical shaped portion having a smaller diameter end adjacent the first sleeve end and a larger diameter opposite end located at an intermediate location along the sleeve, the second frusto-conical shaped portion extending from a smaller diameter end thereof contiguous with the larger diameter end of the first frusto-conical shaped portion to a larger diameter opposite end spaced from the second sleeve end, the axial rate of taper of the first frusto-conical shaped portion exceeding the axial rate of taper of the second frusto-conical shaped portion, said third frusto-conical shaped portion extending from and contiguous with the larger diameter end of the second frusto-conical shaped portion to adjacent the second opposite sleeve end, said third frusto-conical shaped portion having its smallest diameter adjacent to said second sleeve end.

10. The honing mandrel defined in claim 9 wherein a relatively shallow helical groove is formed in the outer work engaging surface and extends around the sleeve from end-to-end thereof.

11. The honing mandrel defined in claim 9 wherein the axial taper of the first frusto-conical shaped sleeve portion is at a rate between approximately 0.001 inch per inch and 0.010 inch per inch, and the axial taper of the second frusto-conical shaped sleeve portion is at a rate between approximately 0.0001 inch per inch and 0.004 inch per inch.

12. A honing mandrel for honing bores in workpieces comprising an arbor having a first portion for mounting on a honing machine, a second portion integral with the first portion, said second portion being axially tapered from end-to-end, a groove formed in said tapered portion at an intermediate location therealong, a sleeve having an outer abrasive work engaging surface formed by particles of an abrasive substance in a binder, said sleeve having spaced first and second opposite ends of which has a notch formed therein and a tapered inner surface extending therebetween, the taper of said inner surface corresponding with the taper of the second arbor portion so that the sleeve can be positioned on the second arbor portion in surface-to-surface engagement therewith, a slot through said sleeve extending the length thereof enabling the sleeve to expand and contract when moved axially on the second arbor portion, said outer abrasive surface having first, second and third frusto-conical shaped surface portions which together extend most of the distance between the spaced first and second opposite sleeve ends, the first frusto-conical shaped surface portion having a smaller diameter end adjacent to the first sleeve end and a larger diameter opposite end located at an intermediate location along the sleeve, the second frusto-conical-shaped surface portion extending from a smaller diameter end thereof that is contiguous with the larger diameter end of the first frusto-conical shaped surface portion to a larger diameter opposite end space from the second sleeve end, the axial rate of taper of the first frusto-conical shaped surface portion exceeding the axial rate of taper of the second frusto-conical shaped surface portion, said third frusto-conical shaped surface portion extending from and contiguous with the larger diameter end of the second frusto-conical shaped surface portion to its smallest diameter adjacent the second opposite sleeve end, and a pilot member having a tapered inner surface for mating with the tapered second arbor portion and an end surface for abutting the first sleeve end, said pilot member having a slot therethrough extending the length thereof to enable expansion and contraction thereof.

13. The honing mandrel defined in claim 12 wherein the pilot member has at least one axially extending groove formed therein to facilitate expansion and contraction thereof.

14. The honing mandrel defined in claim 12 including means to prevent relative rotational movement between the sleeve and the arbor.

15. The honing mandrel defined in claim 14 wherein the means to prevent relative rotational movement includes a groove formed in the second arbor portion, a notch formed extending into one end of the sleeve, and a key member having a first portion in the groove and a second portion in the notch.

16. The honing mandrel defined in claim 15 wherein the groove in the second arbor portion has a portion that accommodates the first key portion that has a uniform depth.

* * * * *

UNITED STATES PATENT AND TRADEMARK OFFICE

CERTIFICATE OF CORRECTION

PATENT NO. : 4,253,279
DATED : March 3, 1981
INVENTOR(S) : Wayne W. Althen

It is certified that error appears in the above-indentified patent and that said Letters Patent is hereby corrected as shown below:

Column 9, line 49, "and" should be --an--.

Column 9, lines 52 and 53, "constant" should be deleted.

Column 9, line 60, "rate of the axial" should read --rate of axial--.

Column 11, line 11, "ends of" should read --ends one of--.

Column 11, line 31, "space" should be --spaced--.

Signed and Sealed this

Fourth Day of April, 1995

Bruce Lehman

*Attest:*

BRUCE LEHMAN

*Attesting Officer*

*Commissioner of Patents and Trademarks*